United States Patent [19]

Riches et al.

[11] 4,322,121

[45] Mar. 30, 1982

[54] SCREW-COUPLED ELECTRICAL CONNECTORS

[75] Inventors: Arthur J. Riches, Herne Bay; Robert D. Wallace, Swalecliffe, both of England

[73] Assignee: Bunker Ramo Corporation, Oak Brook, Ill.

[21] Appl. No.: 117,890

[22] Filed: Feb. 1, 1980

[30] Foreign Application Priority Data

Feb. 6, 1979 [GB] United Kingdom ..... 04066/79

[51] Int. Cl.[3] ..... H01R 13/639

[52] U.S. Cl. ..... 339/89 M; 339/113 R; 285/91

[58] Field of Search ..... 339/89 R–90 C, 339/91 B, 113 R; 285/81, 87, 88, 91; 151/34

[56] References Cited

U.S. PATENT DOCUMENTS

| | | | |
|---|---|---|---|
| 3,750,087 | 7/1973 | Vetter | 339/90 R |
| 3,786,396 | 1/1974 | Kemmer et al. | 339/89 R |
| 3,917,373 | 11/1975 | Peterson | 339/89 R |

*Primary Examiner*—Eugene F. Desmond

*Attorney, Agent, or Firm*—Frederick M. Arbuckle; John R. Hoffman

[57] ABSTRACT

The invention relates to screw-coupled electrical connectors. It is known to provide screw-coupled electrical connectors with means for providing an indication of the fact that the two parts are approaching or have reached the fully mated condition and for resisting subsequent rotation of the coupling sleeve in the uncoupling direction. However, this has been accomplished only with complex and expensive mechanisms such as movable balls mounted in a flange on the first connector part and a series of holes in a flange on the coupling sleeve. According to the invention, there is provided an improved first part of a two-part, screw-coupled electrical connector, the first part having first and second annular elements arranged coaxially with the first part and immediately axially adjacent to one another, there being defined in the first annular element a set of circumferentially spaced thrust-member-receiving regions to be engaged by thrust-members supported in a set of thrust-member-supporting regions in the second annular element, one of the annular elements being arranged to rotate relative to the first part together with the coupling sleeve and the annular element being constrained against rotation relative to the first part, means being provided resiliently to urge the thrust-members and the first annular element towards one another and to cause sequential engagement of thrust-member-receiving regions by the thrust-members when the two connector-parts approach the fully-mated condition.

11 Claims, 5 Drawing Figures

SCREW-COUPLED ELECTRICAL CONNECTORS

TECHNICAL FIELD

The invention relates to screw-coupled electrical connectors.

BACKGROUND OF THE PRIOR ART

In a screw-coupled electrical connector, an internally screw-threaded coupling sleeve is mounted on a first of the parts to enable the second connector-part, which is provided with an external screw-thread, to be drawn towards the first part. Hereinafter the expressions "coupling direction of rotation of the coupling sleeve" and "uncoupling direction of rotation of the coupling sleeve" means respectively the directions in which the coupling sleeve is rotated to draw the connector parts together and to enable separation of the two connector parts. It is known to provide screw-coupled electrical connectors with means for providing an indication of the fact that the two parts are approaching or have reached the fully mated condition and for resisting subsequent rotation of the coupling sleeve in the uncoupling direction. To this end it has been proposed to provide a series of circumferentially spaced smaller movable balls mounted in a flange on the first connector part and a series of holes in a flange on the coupling sleeve. As the coupling sleeve is rotated in the coupling direction the balls sequentially engage the holes and in doing so provide audible clicks. When the connector-parts are fully-mated, the engagement between the balls and the holes provides resistance to rotation of the coupling sleeve in the uncoupling direction which could result, for example, from vibration. It has also been proposed to replace the balls and holes by protrusions and indentations which may be defined on washers instead of flanges.

BRIEF SUMMARY OF THE INVENTION

According to the invention, there is provided a first part of a two-part, screw-coupled electrical connector, the first part having an internally screw-threaded coupling sleeve mounted coaxially and rotatably thereon to enable a second, externally screw-threaded complementary connector-part to be drawn towards the first part, wherein there are provided first and second annular elements arranged coaxially with the first part and immediately axially adjacent to one another, there being defined in the first annular element a set of circumferentially spaced thrust-member-receiving regions to be engaged by thrust-members supported in a set of thrust-member-supporting regions in the second annular element, one of the annular elements being arranged to rotate relative to the first part together with the coupling sleeve and the annular element being constrained against rotation relative to the first part, means being provided resiliently to urge the thrust-members and the first annular element towards one another and to cause sequential engagement of thrust-member-receiving regions by the thrust-members when the two connector-parts approach the fully-mate condition, wherein each of the regions in at least one of said sets of regions is asymmetrical about any plane containing the axis of the said first part and extending radially through that region, the asymmetry being such that the engagement between thrust-members and thrust-member-receiving regions provides more resistance to rotation of the coupling sleeve in the uncoupling direction than in the coupling direction.

In a preferred embodiment of the invention, the thrust-members are pins and the asymmetry is such that the pins are skewed relative to the axis of the first connector-part. The skewing of the pins is such that the pins are inclined relative to their contact with the first annular element in the direction in which they move relative to the first annular element when the coupling sleeve is rotated in the coupling direction.

The thrust-member receiving regions can be, for example, in the form of part-spherical indentations, whereby the resistance to rotation of the coupling sleeve by virtue solely of the inclination of the pins is greater in the direction of uncoupling than in the direction of coupling. Such differential resistance can be aided by applying the said asymmetry to the indentations in addition to the thrust-member supporting regions.

BRIEF DESCRIPTION OF THE DRAWINGS

The invention will be further described by way of example and with reference to the accompanying drawings, in which.

DETAILED DESCRIPTION OF THE INVENTION

Figure 1:
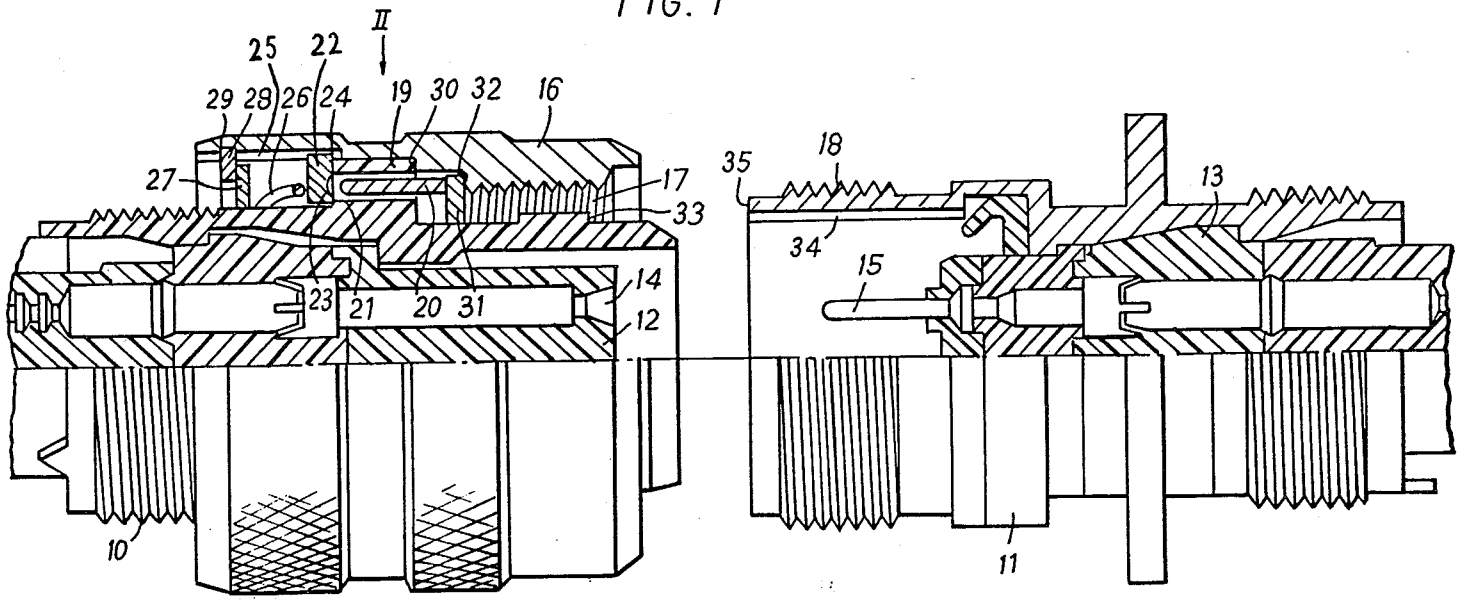
FIG. 1 is a side elevation, partly in section, of two parts of a screw-coupled electrical connector having a first connector-part constructed according to the invention.

Referring to the drawings, FIG. 1 shows a screw-coupled electrical connector comprising a first connector-part 10 and a second connector-part 11. The first and second connector-parts are generally cylindrical and have inserts 12 and 13, respectively, of an electrically insulating material which support sockets 14 and complementary contact pins 15 respectively. Only one socket and one contact pin are shown in FIG. 1. A coupling sleeve 16 is mounted coaxially and rotatably on the first part 10 and is provided with an internal screw-thread 17 at its forward end, i.e., the end nearest the second connector-part. The second connector-part is provided with a complementary external screw-thread 18 to enable the second part to be drawn towards the first part by rotation of the coupling sleeve 16 in the coupling direction.

A plurality of thrust-members in the form of pins 20 are slidably supported in a set of thrust-member-supporting regions, which are bores 21 in a radially outwardly extending annular flange 19 on the first part 10. Immediately to the rear of the flange 19 is a washer 22, in the front face of which there is defined a set of circumferentially spaced thrust-member-receiving regions, which are part-spherical indentations 23 arranged to be engageable by the pins 20. The washer 22 has two keys 24 which extend radially outwardly to engage keyways 25 in the coupling sleeve 16, whereby the washer 22, although axially movable relative to the coupling sleeve 16 and first part 10, is constrained to rotate with the coupling sleeve 16 relative to the first part 10.

Only one pin 20, one bore 21, one indentation 23, one key 24 and one keyway 25 are shown in FIG. 1.

Figure 2:
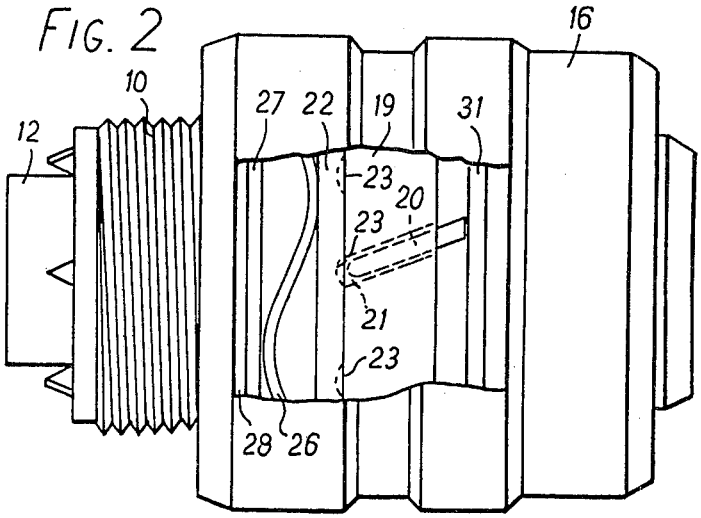
FIG. 2 is a view of the first connector-part and coupling sleeve in the direction indicated by the arrow II in FIG. 1, part of the coupling sleeve being cut away.

Referring now to FIG. 2, each of the thrust-member-supporting regions, i.e., the bores 21, is asymmetrical about any plane containing the axis of the first part 10 and extending radially through the region. The asymmetry is such that the pins 20 are skewed relative to the axis of the first part, the pins being inclined relative to their contact with the washer 22 in the direction in which they move relative to the washer 22 when the coupling sleeve 16 is rotated in the coupling direction. The pins 20 are preferably inclined through approximately 10° from parallelism with the axis of the first part 10. There are preferably more indentations 23 than pins 20, for example, there are preferably three pins and twelve indentations. The pins and indentations should be evenly spaced and the number of indentations should be an integral multiple of the number of pins, whereby when one pin is in engagement with an indentation the remainder of the pins are also in engagement with indentations. For clarity, the key 24 shown in FIG. 1 has been omitted from FIG. 2.

Referring again to FIG. 1, to the rear of the washer 22 is a spring-washer 26, a washer 27 and a retaining washer 28 which is located in an annular groove 29 in the internal surface of the coupling sleeve 16. The spring-washer 26 is in compression between the washer 22 and the washer 27, the rear face of which acts against the retaining washer 28, whereby the spring-washer serves to urge the washer 22 forwardly into engagement with the annular flange 19 and to urge the coupling sleeve 16 rearwardly relative to the first part 10 such that an abutment surface 30 extending radially inwardly from the coupling sleeve abuts against the front face of the annular flange 19 on the first part. Thus the arrangement of spring washer 26, flange 19 and washers 22, 27 and 28 serves to retain the coupling sleeve 16 on the first part 10.

The forward ends of the pins 20 engage an axially movable thrust-washer 31, the movement of which, relative to the coupling sleeve 16, is limited in the forward direction by engagement with an abutment surface 32 extending radially inwardly from the coupling sleeve. The length of the pins 20, the thickness of the annular flange 19, and the distance between the two abutment surfaces 30 and 32 are such that when the coupling sleeve 16 is in its rearwardmost position relative to the first part 10 (i.e., when the abutment surface 30 is engaging the flange 19) and when the pins 20 are in their forwardmost positions relative to the first part 10 (i.e., when the pins are engaging the thrust-washer 31 which is engaging the abutment surface 32), the rear ends of the pins 20 do not project from the bores 21 in the flange 19. This situation is shown in FIGS. 1 and 2. In this situation the coupling sleeve 16 together with the washer 22 can rotate freely with respect to the first connector-part 10 without the indentations 23 being engaged by the pins 20.

The spring-washer 26, washer 27, retaining washer 28, thrust-washer 31 and insert 12 are also shown in FIG. 2.

To couple the two connector-parts, they are moved together in a relative orientation which allows a key 33 on the first part to engage a keyway 34 in the second part (see FIG. 1). The key 33 and keyway 34 are provided to ensure that the two parts are coupled only in the orientation in which the contact pins 15 mate with the corresponding sockets 14. The screw-thread 17 in the coupling sleeve 16 is caused to engage the screw-thread 18 on the second connector-part and the coupling sleeve is rotated in the coupling direction to draw the two connector-parts together and mate the contact pins with the sockets.

When the connector-parts approach the fully-mated condition the leading edge 35 of the second part engages the forward face of the thrust-washer 31, and urges the thrust-washer and hence the pins 20 rearwardly relative to the first part. As the two connector-parts are drawn closer together by further rotation of the coupling sleeve 16 in the coupling direction, the pins 20 are caused to project from the rear ends of the bores 21 in the flange 19, and to engage the indentations 23 sequentially in the washer 22 as it rotates with the coupling sleeve. The sequential engagement of the indentations 23 by the pins 20 provides an audible indication that the two connector-parts have approached the fully-mated condition.

As a result of the skewed arrangement of the pins 20, the engagement between the pins and indentation 23 is such as to provide a greater resistance to rotation of the coupling sleeve 16 in the uncoupling direction than in the coupling direction. The extent of the resistance to rotation depends on the force with which the pins and the washer 22 are urged together when the pins are engaging indentations. Drawing the second connector-part 11 towards the first connector-part beyond the position at which engagement of indentations by the pins commences, increases this force as a result of compression of the spring-washer 26.

It will be appreciated that the invention is not limited to the one embodiment described above. In particular, the desired result of greater resistance to rotation of the coupling sleeve in the uncoupling direction than in the coupling direction can be achieved by the use of thrust-members which are directed, and movable, axially to engage thrust-member-receiving regions, each of which is asymmetrical about any plane containing the axis of the first connector-part and extending radially through that region. The thrust-members can be pins, ball-bearings or rollers arranged with their axes extending radially with respect to the first connector-part. Each thrust-member-receiving region can be an indentation having one steep slope and one gradual slope, the arrangement of the slopes being such that, during sequential engagement of indentations by thrust-members as the coupling sleeve is rotated in the coupling direction, the thrust-members enter the indentations down the steep slope and leave up the gradual slope. The engagement between the indentations and the thrust-members provides a greater resistance to rotation of the coupling sleeve in the uncoupling direction because the thrust-members must then pass up the steep slopes in order to leave the indentations.

Figure 3:
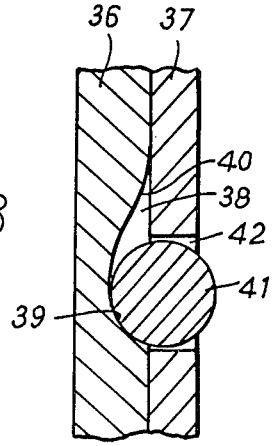
FIGS. 3 to 5 are each a section through a thrust-member, and through parts of a washer and a flange on a first connector-part constructed according to the invention.
Figure 4:
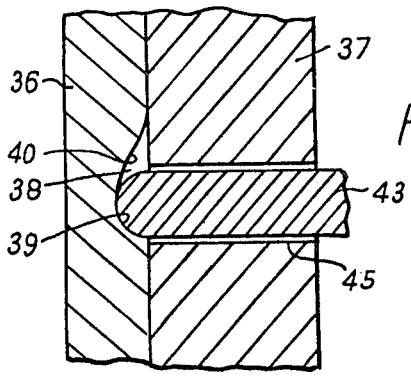
Figure 5:
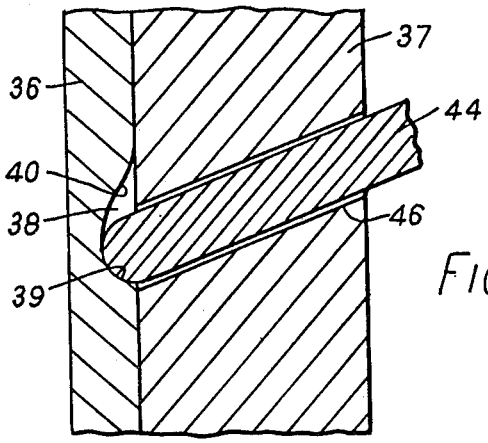

Referring to FIGS. 3 to 5, each figure shows part of a washer 36 arranged adjacent a flange 37 on a first connector-part. In the front face of the washer 36 there is defined a series of indentations 38, one indentation 38 being shown in each figure. The washer 36 and flange 37 are identical to the washer 22 and flange 19 shown in FIGS. 1 and 2 except for the shape of the indentations and the arrangement of the thrust members supported by the flange. Each indentation 38 has a steep slope 39 and a gradual slope 40, and is asymmetrical about any plane containing the axis of the connector part on which the washer 36 is mounted and extending radially through the indentation. In FIG. 3 a thrust-member in the form of a ball-bearing 41 is shown supported in an axially directed bore 42 in the flange 37. The ball-bearing can be replaced by a roller arranged with its axis extending radially with respect to the first connector-part, if the thrust-member-supporting region i.e., the hole in the flange 37 is prepared accordingly. In FIGS. 4 and 5 thrust-members in the form of pins 43 and 44 respectively are shown. In FIG. 4 the pin 43 is supported in an axially directed bore 45 in the flange 37, whereas in FIG. 5 the pin 44 is supported in a bore 46 so arranged that the pin is skewed relative to the axis of the first part in an identical manner to the skewed pins 20 shown in FIGS. 1 and 2. Referring now to all of FIGS. 3 to 5 the thrust-members 41, 43, 44 are each shown in engagement with an indentation 38, the thrust-members having been urged into engagement with the indentations when the two connector-parts approached the fully-mated condition. On further rotation of the coupling sleeve in the coupling direction the washer 36 rotates relative to the flange 37 and the thrust-members pass up the gradual slopes 40 of the indentations 38 and along the face of the washer 36 until they enter the neat indentations down the steep slopes 39. On rotation of the coupling sleeve in the uncoupling direction the thrust-members are caused to leave the indentations up the steep slopes 39 whereby the engagement betweeen thrust-members and indentations provides greater resistance to rotation of the coupling sleeve in the uncoupling direction than in the coupling direction.

In the arrangement shown in FIG. 5 the effect of asymmetry of the indentations is added to the effect of asymmetry in the thrust-member supporting regions i.e., the skewing of the pins relative to the axis of the first connector-part.

In the embodiment of the invention shown in the drawings the thrust-members are supported in a flange on the first connector-part. An alternative construction is to support the thrust-members in a washer constrained against rotation relative to the first connector-part, for example by means of a key and keyway. The flange 19 shown in the drawings serves to retain the coupling sleeve in the first part in addition to supporting the thrust-members, and if it is replaced by a washer supporting the thrust-members then some other means must be employed to retain the coupling sleeve on the first part. The arrangement of the washers, thrust-members and spring-washer along the axis of the first part need not be as shown in the drawings. The important considerations are that two annular elements be arranged immediately axially adjacent, the thrust-member-receiving regions being defined in a first of the annular elements and the thrust-members being supported in the second. One of the annular elements must be arranged to rotate relative to the first connector-part together with the coupling sleeve and the other annular element must be constrained against rotation relative to the first connector-part. Means must be provided to urge the thrust-members and the first annular element towards one another to cause sequential engagement of thrust-member-receiving regions by the thrust-members when, and only when, the two connector-parts approach the fully-mated condition, in order that the sequential engagement provides an audible indication of the relative positions of the two connector-parts.

We claim:

1. A first connector part for connecting with a mating connector part to form a two-part, rotatably-coupled electrical connector, said first connector part comprising: a coupling sleeve mounted coaxially and rotatably thereon to enable a mating, complementary connector part to be drawn towards said first connector part by complementary engaging means between the coupling sleeve and the complementary connector part; first and second annular elements arranged coaxially with said first part and immediately axially adjacent to one another, said first annular element having a set of circumferentially spaced thrust-member-receiving regions, said second annular element including a plurality of thrust-members supported in a set of thrust-member-supporting regions in said second annular element, one of said annular elements being arranged to rotate relative to the first part together with the coupling sleeve, and the other annular element being constrained against rotation relative to the first part; resilient means for urging the thrust-members and said first annular element towards one another and to cause sequential engagement of said thrust-member-receiving regions by said thrust-members when the two connector parts approach the fully-mated condition; wherein each of the regions in the set of thrust-member-supporting regions is asymmetrical about any plane containing the axis of said first connector part and extending radially through that region, the asymmetry being such that the engagement between thrust-members and thrust-member-receiving regions provides more resistance to rotation of said coupling sleeve in the uncoupling direction than in the coupling direction.

2. The first connector part as claimed in claim 1, wherein the thrust-members are pins slidably mounted in the thrust-member-supporting regions, the asymmetry of the thrust-member-supporting regions being such that the pins are skewed relative to the axis of the first part.

3. The first connector part as claimed in claim 2, wherein the pins are inclined through approximately 10° from parallelism with the axis of the first part.

4. The first connector part as claimed in claim 1, wherein said thrust-member receiving regions are substantially part-spherical indentations in said first annular element.

5. The first connector part as claimed in claim 1, wherein said sequential engagement of thrust-member-receiving regions by thrust-members is such as to provide an audible indication that the two connector-parts have approached the fully-mated condition.

6. A first connector part for connecting with a mating connector part to form a two-part, rotatably-coupled electrical connector, said first connector part comprising: a coupling sleeve mounted coaxially and rotatably thereon to enable a mating, complementary connector part to be drawn towards said first connector part by complementary engaging means between the coupling sleeve and the complementary connector part; first and second annular elements arranged coaxially with said first part and immediately axially adjacent to one another, said first annular element being arranged to the rear of said second annular element, said first annular element having a set of circumferentially spaced thrust-member-receiving regions, said second annular element including a plurality of thrust-members supported in a set of thrust-member-supporting regions in said second annular element, one of said annular elements being arranged to rotate relative to the first part together with the coupling sleeve, and the other annular element being constrained against rotation relative to the first part; resilient means for urging said first annular element forwardly towards the rear face of said second annular element, said thrust members being arranged to be urged rearwardly towards said first annular element by said mating connector part when the two connector parts approach the fully-mated condition; wherein each of the regions in at least one of said sets of regions is asymmetrical about any plane containing the axis of the said first connector part and extending radially through that region, the asymmetry being such that the engagement between thrust-members and thrust-member-receiving regions provides more resistance to rotation of said coupling sleeve in the uncoupling direction than in the coupling direction.

7. The first connector part as claimed in claim 6, including an axially-movable thrust-washer arranged in front of said second annular element for engagement with the forward ends of said thrust-members, said thrust-washer being engaged and urged rearwardly by the leading edge of said second connector-part when the two connector-parts approach the fully-mated condition, whereby said thrust-members are urged rearwardly towards said first annular element.

8. A first connector part for connecting with a mating connector part to form a two-part, rotatably coupled electrical connector, said first connector part comprising: a coupling sleeve mounted coaxially and rotatably thereon to enable a mating, complementary connector part to be drawn towards said first connector part by complementary engaging means between the coupling sleeve and the complementary connector part; first and second annular elements arranged coaxially with said first part and immediately axially adjacent to one another, said first annular element comprising a washer having a set of circumferentially spaced thrust-member-receiving regions, said second annular element including a plurality of thrust-members supported in a set of thrust-member-supporting regions in said second annular element, the washer being arranged to rotate relative to the first part together with the coupling sleeve, and the second annular element being constrained against rotation relative to the first part; resilient means for urging the thrust-members and said first annular element towards one another and to cause sequential engagement of said thrust-member-receiving regions by said thrust-members when the two connector parts approach the fully-mated condition; wherein each of the regions in at least one of said sets of regions is asymmetrical about any plane containing the axis of the said first connector part and extending radially through that region, the asymmetry being such that the engagement between thrust-members and thrust-member-receiving regions provides more resistance to rotation of said coupling sleeve in the uncoupling direction than in the coupling direction.

9. The first connector part as claimed in claim 8, wherein said second annular element is an annular flange extending radially outwardly from said first connector part.

10. The first connector part as claimed in claim 9, wherein said first connector part further comprises: a first abutment surface extending radially inwardly from said coupling sleeve for engagement with the front face of the said annular flange on said first connector part; a spring-washer for urging said coupling sleeve rearwardly with respect to said first connector part by the action of said spring-washer which is in compression between a retaining washer located in an annular groove near the rear end of said coupling sleeve and said washer which is arranged to the rear of the said flange; an axially-movable thrust-member arranged in front of said flange for engagement with the forward ends of said thrust-members, the forward axial movement of said thrust-washer being limited by engagement with a second abutment surface extending radially inwardly from said coupling sleeve, the width of the said flange, the distance between said first and second abutment surfaces, and the dimensions of said thrust-members being such that when said coupling sleeve is in its rearward-most position relative to said first connector part and said thrust-members are in their forwardmost positions relative to said first connector part, the rear end of said thrust members do not engage said thrust-member-receiving regions.

11. A first connector part for connecting with a mating connector part to form a two-part, rotatably-coupled electrical connector, said first connector part comprising:

a coupling sleeve carried by said first connector part to enable a mating, complementary connector part to be drawn towards said first connector part by complementary engaging means between the coupling sleeve and the complementary connector part;

first and second annular elements arranged coaxially with said first connector part and immediately adjacent to one another, said first annular element having a set of circumferentially spaced thrust-member-receiving regions, said second annular element including a plurality of pins supported in a set of thrust-member-supporting regions in said second annular element, the pins being skewed relative to the axis of the first connector part; and resilient means for urging the pins and said first annular element towards one another to cause sequential engagement of the pins in said thrust-member-receiving regions when the two connector parts approach the fully-mated condition, said skewed pins providing more resistance to rotation of said coupling sleeve in the uncoupling direction than in the coupling direction.

* * * * *

UNITED STATES PATENT AND TRADEMARK OFFICE

CERTIFICATE OF CORRECTION

PATENT NO. : 4,322,121

DATED : March 30, 1982

INVENTOR(S) : A. Riches and D. Taylor

It is certified that error appears in the above-identified patent and that said Letters Patent are hereby corrected as shown below:

On the title page, delete "Robert D. Wallace" and insert --Derek Taylor--.

Signed and Sealed this

Sixteenth Day of November 1982

[SEAL]

*Attest:*

GERALD J. MOSSINGHOFF

*Attesting Officer*

*Commissioner of Patents and Trademarks*